United States Patent [19]

Pallmann

[11] 4,213,572

[45] Jul. 22, 1980

[54] BLADE HOLDER

[75] Inventor: Wilhelm Pallmann, Zweibrücken, Fed. Rep. of Germany

[73] Assignee: Pallmann KG Maschinenfabrik, Zweibrücken, Fed. Rep. of Germany

[21] Appl. No.: 906,990

[22] Filed: May 17, 1978

[30] Foreign Application Priority Data

May 18, 1977 [DE] Fed. Rep. of Germany ..... 2722522

[51] Int. Cl.[2] ..... B02C 18/18

[52] U.S. Cl. ..... 241/292.1; 144/218; 145/5 R; 241/294

[58] Field of Search ..... 145/4, 5 R, 16; 241/294, 282.2, 192, 292.1, 300.1; 144/218, 230; 83/698

[56] References Cited

U.S. PATENT DOCUMENTS

| | | | |
|---|---|---|---|
| 16,805 | 3/1857 | Nichols | 145/16 |
| 976,301 | 11/1910 | Ross | 144/224 |
| 1,021,202 | 3/1912 | Marsh | 144/230 |
| 1,980,056 | 11/1934 | Hedely | 145/4 |
| 2,701,416 | 2/1955 | Snyder | 145/5 R |

*Primary Examiner*—Richard B. Lazarus

*Attorney, Agent, or Firm*—Becker & Becker, Inc.

[57] ABSTRACT

A blade holder for machine blades, especially for blades which are arranged in an annular fashion along the periphery of cutting tools. The blade holder has a blade carrier and a blade holding plate which is detachably mounted on the blade carrier by at least one bolt. The blade holding plate at least partially covers the blade, which is supported on the blade carrier, while leaving the cutting edge exposed. The blade holder plate, which is removable from the bolt, is provided with an opening for a nut which is seated on the bolt.

2 Claims, 7 Drawing Figures

BLADE HOLDER

The present invention relates to a blade holder for machine blades, especially for blades which are arranged in an annular fashion along the periphery of cutting tools. The blade holder has a blade carrier and a blade holding plate which is detachably mounted on the blade carrier by at least one bolt. The blade holding plate entirely or partially covers the blade, which is supported on the blade carrier, while leaving the cutting edge exposed.

Such holders are used, for example, with annular tools of cutters and similar processing machines, which have blade rings, grinding rings, or beater wheels, or with which the blades are connected to filter bodies. These blade holders are designed in such a way that the blades can be exchanged after wear by removing the worn blades individually or together with their respective blade carriers.

Numerous holders for blades of this type are known. The blades can, for example, be replaced by automatic changing devices which are designed and operate very economically. With machines which have not yet been in operation for a long time the known changing devices have proved very satisfactory. However, if these machines have been operated for a longer time, not only do the blades show wear, but the carrying devices for the blades are also often worn out and damaged to such an extent that they have to be replaced.

It is, therefore, an object of the present invention to be able in a simple manner to eliminate the different phenomena of wear which occur during operation.

This object and other objects and advantages of the present invention will appear more clearly from the following specification in connection with the accompanying drawings, in which.

The blade holder of the present invention is characterized primarily in that the blade holder plate is removable from the bolt which is located in the blade carrier, and in that the blade holder plate has an opening for a nut seated on the bolt.

With the blade holder of the present invention, the mounting bolts are non-detachably held on the blade carrier. In order to remove the blade, the nuts need only be loosened, but need not be completely removed from the bolts. The blades can be removed from the blade carrier either alone or along with the blade holder plate, and can be replaced by other blades or blade units.

If, for example, with the blades of an annular blade carrier, only the customary wear phenomena occur, the blade carrier need not be replaced. However, the blade carrier can also, in a known manner, be replaced as a unit together with the blade and holder mounted on the blade carrier if, after a long period of operation, corresponding wear phenomena occur. Also with such a design and arrangement of the blade carrier, the blade with the inventive holder can be replaced whenever required.

Figure 1:
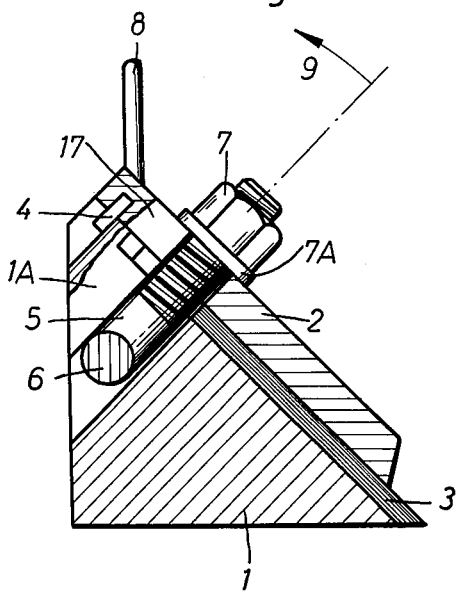
FIG. 1 is a cross section through a segment of a blade carrier of a blade ring for a blade ring cutter, according to which the blade unit, which comprises blade holding plate and blade, is attached to the blade carrier segment, ready to use, by means of a pivot bolt.
Figure 2:
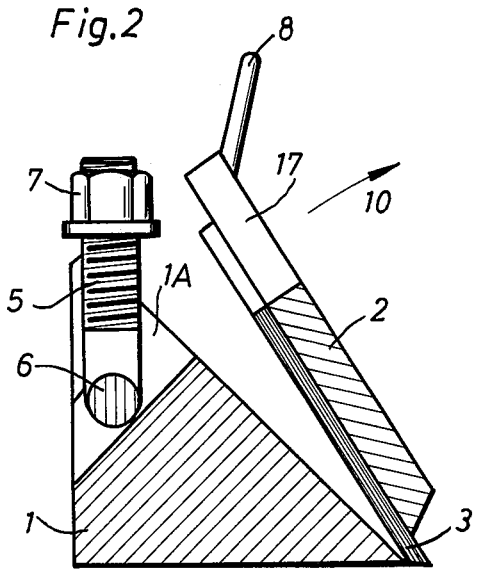
FIG. 2 shows the arrangement of FIG. 1 with the pivot bolt loosened and pivoted, and the blade unit in the removal position.
Figure 3:
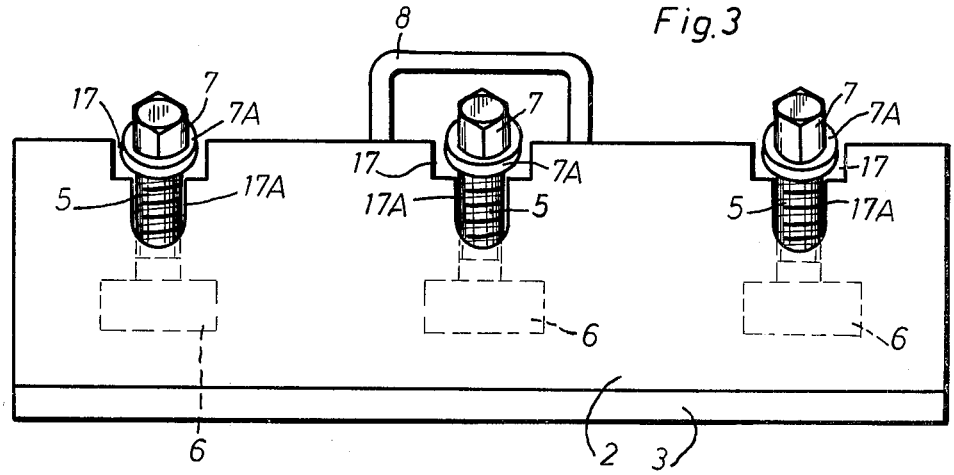
FIG. 3 is a top view of the fastening of a blade unit with the pivot bolts in the removal position.
Figure 4:
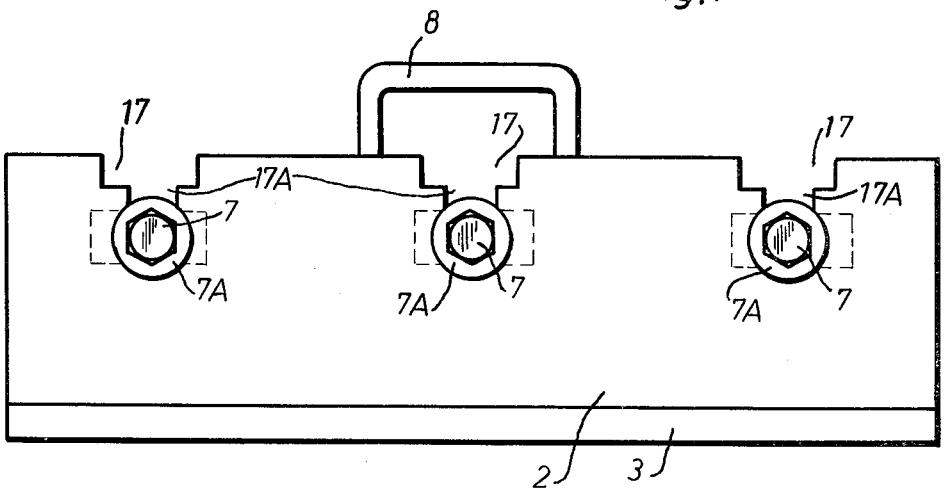
FIG. 4 is a top view as in FIG. 3, but with the blade unit in the operating position.

Referring now to the drawings in detail, the blade mounting of FIGS. 1–4 shows a blade 3 which, together with a blade holder plate 2, is mounted on a blade carrier 1 with three pivot bolts 5, each of which is held by a cap nut 7. An adjusting piece 4 is provided for precise positioning of the blade holder plate 2 and the blade 3. Each bolt 5 is provided with a cylindrical transverse pin 6, which is mounted at the lower end of the bolt shaft perpendicular to the longitudinal axis of said shaft. The transverse pin 6 is rotatably mounted in the blade carrier 1. To replace the blade 3, and, as the case may be, also the blade holder plate 2, the cap nuts 7 are loosened and the pivot bolts 5 are pivoted about the axes of their respective transverse bolts 6 in the direction of the arrow 9 (FIG. 1). A recess 17 is provided in the blade holder plate 2 for every pivot bolt 5 to allow passage of nut 7. The blade carrier 1 has respective corresponding recesses 1A, so that the pivot bolts 5 with their cap nuts 7 can be folded back out of the position of FIG. 1 into the release position of FIG. 2. The blade holder plate 2 can then be removed in the direction of arrow 10 by means of the handle 8 mounted on the blade holder plate 2. As shown in FIGS. 3 and 4, each recess 17 is extended, in the direction toward the longitudinal middle of the blade holder plate 2, by a slot 17A, in which the shaft of the pivot bolt 5 rests in the tightening position. In this connection, the cap nut 7, with a washer 7A, is seated on the blade holder plate 2.

Figure 5:
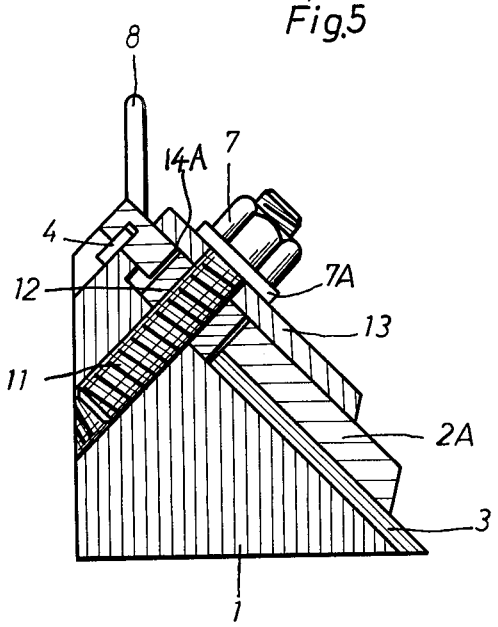
FIG. 5 shows a different embodiment of the blade holder in a view similar to that of FIG. 1, with a stud bolt and a slide plate.
Figure 6:
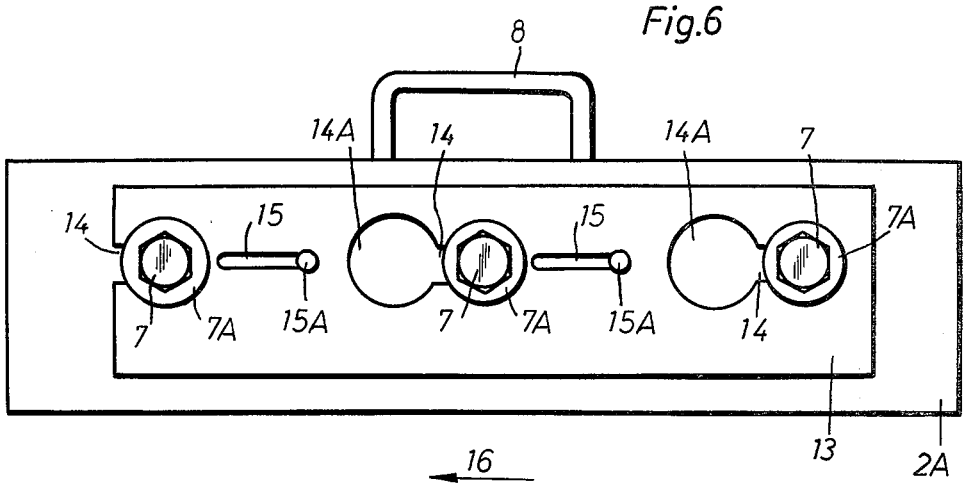
FIG. 6 is a top view showing the mounting of the blade unit of FIG. 5.
Figure 7:
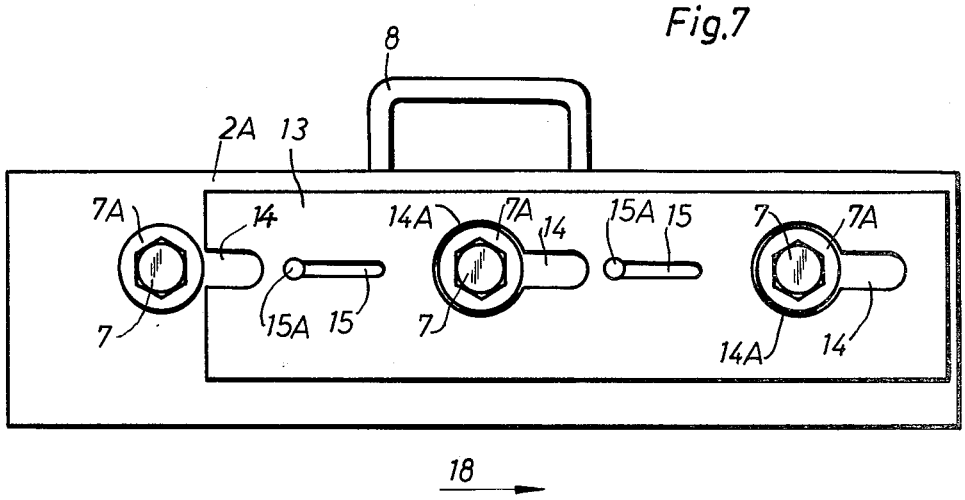
FIG. 7 is a top view corresponding to FIG. 6, with the sliding plate in the removal position.

The embodiment of FIGS. 5–7 shows three stud bolts 11 which are provided for holding the holder plate. The stud bolts 11 connect the blade holder plate and the blade 3 with the blade carrier 1. The cap nut 7 is screwed onto the stud bolt 11. As shown in FIGS. 5 and 6, in the operating position the cap nut 7, with its washer 7A, is seated on a slide plate 13, which, together with a plate 2A, forms the blade holder plate. The position of the blade holder plate and the blade 3 is precisely fixed by means of the adjusting piece 4. For every stud bolt 11, a bore is provided in the plate 2A for receiving a lock or counter nut 12, which keeps the stud bolt 11 from turning. The slide plate 13 is provided with slots 14 which extend in the longitudinal direction of the plate 13 and which, in the operating position, are respectively penetrated by one of the stud bolts 11. The middle slot, and that slot which comes before it in the sliding direction 16, open into respective openings or cut-outs 14A, the cross section of which is greater than the cross section of the washer 7A of the pertaining cap nut 7. The third slot opens on that edge of the slide plate 13 which is transverse to the sliding direction 16. To exchange the blade holder plate and the blade 3, the cap nuts 7 are loosened and the slide plate 13 is then slid out of the clamping position of FIG. 6, in the direction 18 (FIG. 7), until the cut-outs 14A are below the pertaining cap nuts 7. The blade holder plate and the blade 3 can then be removed with the handle 8. To make the sliding movement easier, two guide slots 15 are provided in the slide plate 13. The guide slots 15 are respectively penetrated by a guide pin 15A mounted on the plate 2A. The bolt 11 is then screwed into a blade carrier 1, so that the holder plate, which comprises the two plates 2A and 13, can also be removed as a whole and, after the exchange of the blade carrier 1, can again be used. The adjusting piece 4, in its axial direction, has play in the pertaining receiving opening, in order not to hinder the clamping of the blade holder plate.

The present invention is, of course, in no way limited to the specific showing of the drawings, but also encompasses any modifications within the scope of the appended claims.

What I claim is:

1. A blade holder for machine blades, especially for blades arranged in an annular fashion along the periphery of cutting tools, which blade holder comprises in combination: a blade carrier with recess means; a blade supported on said blade carrier; blade holding means detachably mounted on said blade carrier, for holding said blade in position on said blade carrier, said blade holding means at least partially covering said blade while leaving the cutting edge of said blade exposed; and at least one bolt provided with a transverse pin which is rotatably mounted in said blade carrier and having a nut threaded thereon for detachably mounting said blade holding means on said blade carrier, said blade carrier and blade holding means being provided with recesses for accommodating pivotal movement of said bolt, said blade holding means also having a recess forming a nut passage to allow movement of said nut through said blade holding means without removing said nut from said bolt.

2. A blade holder according to claim 1, which includes three bolts.

* * * * *